US005826456A

United States Patent [19]

Kawazoe et al.

[11] Patent Number: 5,826,456

[45] Date of Patent: Oct. 27, 1998

[54] METHOD FOR EXTRUSION OF ALUMINUM ALLOY AND ALUMINUM ALLOY MATERIAL OF HIGH STRENGTH AND HIGH TOUGHNESS OBTAINED THEREBY

[75] Inventors: Masataka Kawazoe; Junichi Nagahora, both of Sendai; Kenji Higashi, 3-4-9, Teraikedai, Tondabayashi-shi, Osaka-fu, all of Japan

[73] Assignees: YKK Corporation, Tokyo; Kenji Higashi, Osaka, both of Japan

[21] Appl. No.: 713,844

[22] Filed: Sep. 13, 1996

[30] Foreign Application Priority Data

Sep. 14, 1995 [JP] Japan ..... 7-261057
Jul. 8, 1996 [JP] Japan ..... 8-198324

[51] Int. Cl.[6] ..... B21C 23/00

[52] U.S. Cl. ..... 72/253.1; 72/256; 72/377

[58] Field of Search ..... 72/253.1, 256, 72/272, 377

[56] References Cited

U.S. PATENT DOCUMENTS 5,400,633 3/1995 Segal et al. ..... 72/253.1
5,513,512 5/1996 Segal ..... 72/253.1
5,600,989 2/1997 Segal et al. ..... 72/253.1

OTHER PUBLICATIONS

Segal et al., "Simple Shear as a Metalworking Process for Advanced Materials Technology", First International Conference on Processing Materials Society (1993), pp. 947–950.

Working of Metals by Simple Shear Deformation Process, Vladimir Segal, 5th Annual Alum Extruding, 1992.

*Primary Examiner*—Lowell A. Larson
*Assistant Examiner*—Ed Tolan
*Attorney, Agent, or Firm*—Finnegan, Henderson, Farabow, Garrett & Dunner, L.L.P.

[57] ABSTRACT

An aluminum alloy material of high strength and high toughness and a method for the production thereof are disclosed. The material of high strength and high toughness is produced by laterally changing the direction of extrusion of the aluminum alloy thereby imparting shear deformation productive of such strain intensity equals as an equivalent elongation of not less than 220%, preferably not less than 10,000% to the material in the process of extrusion and reducing the average particle diameter of the grains of a microstructure of the material to minute grains not exceeding 1 micron in diameter. The step of extrusion is carried out at a temperature not exceeding 300° C., preferably not exceeding the recrystallization temperature of the alloy, and more preferably not exceeding the recovery temperature thereof.

12 Claims, 14 Drawing Sheets

METHOD FOR EXTRUSION OF ALUMINUM ALLOY AND ALUMINUM ALLOY MATERIAL OF HIGH STRENGTH AND HIGH TOUGHNESS OBTAINED THEREBY

BACKGROUND OF THE INVENTION

1. Field of the Invention

This invention relates to a method for the extrusion of an aluminum alloy and an aluminum alloy material of high strength and high toughness obtained by the method.

2. Description of the Prior Art

It is known that a metallic material made of a metal or an alloy, when deformed, namely subjected to work hardening, gains in strength. This deforming technique on account of a so-called forging effect has been extensively applied for numerous metallic materials for the purpose of improving strength. This popular acceptance of the technique is explained by a supposition that the work (deformation) causes the material under treatment to accumulate various defects (such as, for example, point defects, dislocation, and stacking fault) and, as the result of an interaction between the dislocation and other defects, the material renders the introduction of a new defect or the migration of existing defects difficult and consequently acquires resistance to an external force and ultimately gains in strength.

The forging, however, is at a disadvantage in imposing a limit on the size of a material to be manufactured for practical use because it is generally implemented by such working methods as rolling and stamping which results in decreasing the cross section of the material.

As a means to overcome this disadvantage, V. M. Segal et al. have proposed a method for causing a material under treatment to accumulate large strain (defect) without decreasing the cross section thereof by subjecting the material to such lateral extrusion as entails no decrease in the cross section thereof (ECAE method: Equal-Channel-Angular Extrusion) thereby imparting shear deformation to the material.

Though the metallic material is strengthened by the work hardening, it is normally deprived of ductility (toughness) as a result. The lack of ductility (toughness) poses a serious hindrance to the secondary working of the material and to the application of the material for structural materials.

It is the thermo-mechanical treatment (TMT) that has found utility for practical applications which are aimed at overcoming the disadvantage. The TMT, as a method for controlling the phenomenon of recovery or recrystallization of work texture which proceeds simultaneously with hot working or controlling the phenomenon of the recovery or recrystallization which proceeds during a heat treatment after a cold working thereby effecting fine division of crystal grains and adjustment of texture and ultimately ensuring retention of the ductility (toughness), is applied for numerous ferrous, nonferrous, and other alloys. The intermediate thermo-mechanical treatment (ITMT) and the final thermo-mechanical treatment (FTMT), which are particularly used for an Al—An—Mg—Cu alloy, are excellent methods which are capable of evenly balancing strength and toughness. They both necessitate exacting control and numerous complicated steps and improve strength and ductility (toughness) insufficiently.

Incidentally, the Al—Mg alloy commands the widest utility in all the stretching grade aluminum alloys or wrought aluminum alloys because it acquires proper strength in consequence of solid solution hardening or work hardening and also excels in ductility (formability). As the concentration of Mg as a solute component in this alloy unduly heightens, the alloy suffers occurrence of a streak pattern called a stretcher strain mark when it is deformed at room temperature to a level exceeding the yield point. Meanwhile, on the stress-strain curve, a discontinuous yield occurs repeatedly. This pattern on the curve manifests itself as a serration assuming the shape of the toothed edge of a saw and is referred to as the Portevin-Le Chatelier (PL) effect. This effect is thought to be caused by the fixation of dislocation by the ambience of the solute and the relief thereof from the fixation by the exerted stress. When the serration occurs, the alloy tends to manifest the negative susceptibility to the strain rate, namely the nature of lowering strength in proportion as the strain rate increases. The serration, therefore, gives rise to localization of the deformation and induces degradation of plate formability. Further, the reliability of the alloy itself about impact strength and dynamic fracture toughness is lowered, which poses a hindrance to the efforts to reduce weight.

The metallic material, on being worked strongly, is hardened and greatly strengthened and nevertheless is notably deprived of ductility (toughness) as described above. This degradation of the ductility poses a further obstacle to the working.

In the case of the aluminum alloy material, it is a common practice to subject the material to the thermo-mechanical treatment (TMT) and consequently enable the material to acquire ductility (toughness) aimed at while suffering a slight degree of softening (or it is a normal practice to allow for a decline of toughness where the acquisition of strength is an essential necessity). Though this treatment is a useful method for the purpose of enabling the material to acquire proper strength and toughness, it complicates the process. In many cases, the decrease in cross section of the material is an inevitable consequence of the working.

The Al—Mg alloy, when deformed at room temperature, generates serration and exhibits negative susceptibility to the strain rate as mentioned above. It has been heretofore customary to preclude and repress the occurrence of the negative susceptibility to the strain rate as by setting the working temperature at a level exceeding 150° C. thereby facilitating diffusion of Mg and stabilizing the restraint imposed by the ambience of solute on all the dislocations, by enlarging the particle diameter of crystals thereby decreasing the amplitude of serration and ensuring uniform advance of the deformation, or by heightening the Mg concentration thereby stabilizing the restraint imposed by the ambience of solute on the dislocations.

The methods cited above, however, have the problem of impairing the superiority of the material as by causing the finished formed articles to suffer a decline of strength or sustain stress corrosion cracking.

SUMMARY OF THE INVENTION

An object of the present invention, therefore, is to provide an aluminum alloy material which possesses a texture finely divided into crystal grains of a particle diameter of not more than 1 micron, manifests notably improved strength and toughness as compared with the conventional aluminum alloy, and balances these properties at a very high level.

A further object of the present invention is to provide an aluminum alloy material of high strength which generates substantially no serration, allows generous stretching and drawing, excels in workability, and abounds in shock absorbability and dynamic fracture toughness.

Another object of the present invention is to provide a method for extrusion which permits such aluminum alloy materials as possess the outstanding mechanical properties mentioned above to be manufactured at a low cost.

Still another object of the present invention is to provide a method for the extrusion of an aluminum alloy which permits an aluminum alloy material to acquire enhanced strength by subjecting the material to a cold working subsequently to the step of extrusion.

Yet another object of the present invention is to provide a method for working an aluminum alloy which omits the hot protracted homogenizing heat treatment or annealing treatment generally performed on nearly all conventional aluminum alloys and enables the cast texture of aluminum alloy to succumb to breakage and, at the same time, permit uniform distribution of alloy elements therein.

To accomplish the objects mentioned above, the present invention provides a method for the extrusion of an aluminum alloy, which comprises imparting to the aluminum alloy in the process of extrusion large shear deformation productive of such strain intensity as equals an equivalent elongation of not less than 220%, preferably not less than 10,000%, thereby effecting fine division of the microstructure thereof into crystal grains of an average particle diameter of not more than 1 micron and producing a material of high strength and high toughness. More specifically, this method produces the aluminum material of high strength and high toughness by changing the direction of extrusion of the aluminum alloy material laterally at an inner angle of less than 180° to impart shear deformation to the material without changing the cross-sectional area of the material and exert thereon large strain equalling an equivalent elongation of not less than 220%, preferably not less than 10,000%, thereby effecting fine division of the microstructure thereof into crystal grains of an average particle diameter of not more than 1 micron.

In a preferred embodiment, the step of extrusion mentioned above is carried out at a temperature of not more than 300° C. preferably at a temperature not exceeding the recrystallization temperature of the alloy in use, and more preferably at a temperature not exceeding the recovery temperature thereof.

According to the method of the present invention described above, when the alloy as raw material is A6063 alloy, an aluminum alloy material of high toughness is obtained which has a composition of 0.3 to 0.9% by weight of Mg, 0.2 to 0.8% by weight of Si, less than 1% by weight of other impurities, and the balance of Al, consists of crystal grains or subgrains of an average particle diameter in the range of 0.1 to 1.0 $\mu$m, and exhibits such mechanical properties as a tensile strength of not less than 250 MPa and an elongation of not less then 15%. The aluminum alloy material consequently obtained has a fibrous texture containing elongated crystal grain boundaries and the interiors of the crystal grains are formed of subgrains, 0.1 to 1.0 $\mu$m in average diameter.

The present invention also provides a high-toughness aluminum alloy material having a Mg content in the range of 1 to 9% by weight, consisting of crystal grains or subgrains of an average particle diameter in the range of 0.05 to 1.0 $\mu$m, and repressing the dependency of strength on the strain rate at a strain rate in the range of $1\times10^{-4}$ to $2\times10^{3}$ $s^{-1}$. In the case of an A5056 alloy as the alloy of raw material, for example, the invention provides an aluminum alloy material of high toughness which has a composition of 4.5 to 5.6% by weight of Mg, 0.05 to 0.20% by weight of Mn, 0.05 to 0.20% by weight of Cr, less than 1% by weight of other impurities, and the balance of Al, consists of crystal grains or subgrains of an average particle diameter in the range of 0.05 to 1.0 $\mu$m, and exhibits such mechanical properties as a tensile strength of not less than 350 MPa and an elongation of not less then 15%. The aluminum alloy material consequently obtained has a fibrous texture containing elongated crystal grain boundaries and the interiors of the crystal grains are formed of subgrains, 0.05 to 1.0 $\mu$m in average diameter.

According to another embodiment of the present invention, in the method for the extrusion of an aluminum alloy mentioned above, a method for extrusion is provided which performs cold working additionally on the material subsequently to the step of extrusion thereby enabling the material to acquire further exalted strength.

According to this method, when the raw material is an A6063 alloy, an aluminum alloy material of high toughness exhibiting such mechanical properties as a tensile strength of not less than 350 MPa and an elongation of not less than 5% is obtained by performing cold working at a reduction ratio of not less than 75% to the alloy having the aforementioned composition and consisting of crystal grains or subgrains of an average particle diameter in the range of 0.1 to 1.0 $\mu$m.

Meanwhile, when the alloy of raw material is an A5056 alloy, an aluminum alloy material of high toughness exhibiting such mechanical properties as a tensile strength of not less than 450 MPa and an elongation of not less than 4% is obtained by performing cold working at a reduction ratio of not less than 75% to the alloy having the aforementioned composition and consisting of crystal grains or subgrains of an average particle diameter in the range of 0.05 to 1.0 $\mu$m.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

The method of the present invention affords, by laterally extruding an aluminum alloy at a relatively low temperature, an aluminum alloy material possessing a texture composed of crystal grains of particle diameters of not more than 1 micron, exhibiting notably improved strength and toughness as compared with the conventional aluminum alloy material, and enjoying these properties balanced at a very high level.

Figure 1:
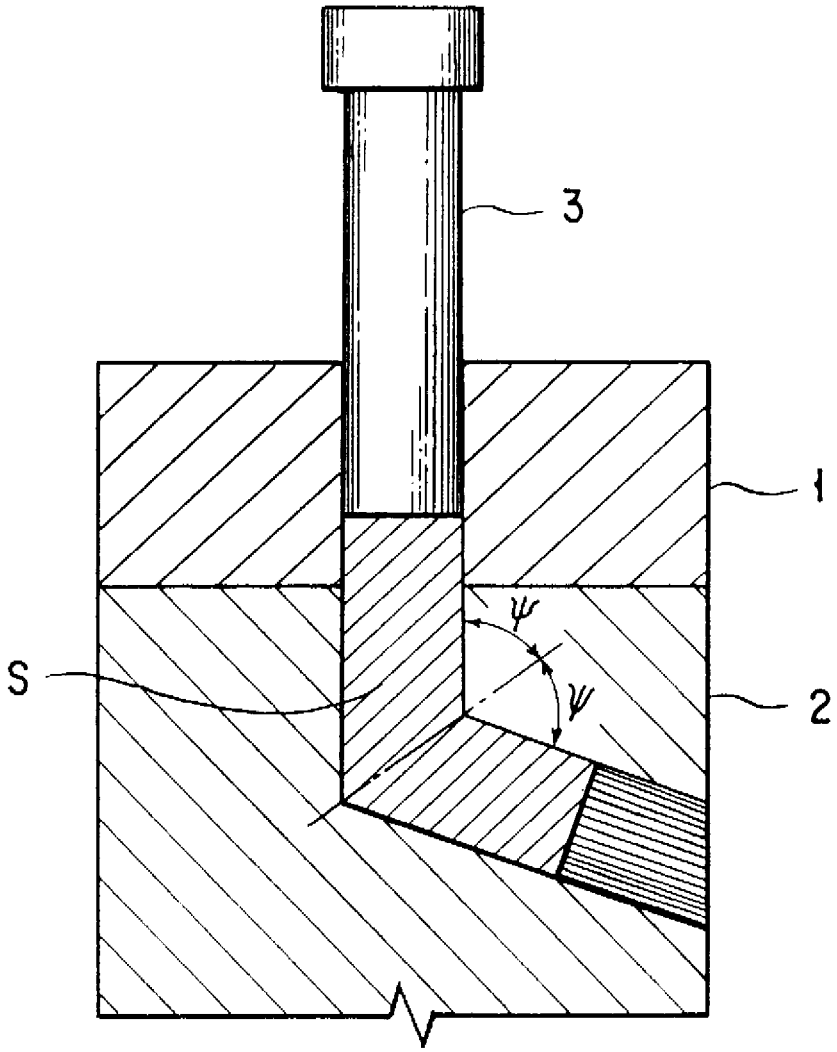
FIG. 1 is a schematic partial cross-sectional view for aiding in the description of the concept of the method for lateral extrusion of an aluminum alloy according to the present invention.

The method for extrusion according to the present invention consists in exerting shear deformation in a lateral direction on an aluminum material by joining two extruding containers or one container 1 and one die 2 severally possessing an identical inner cross section at a proper angle (2ψ) of less than 180°, inserting an aluminum alloy S in the one container 1, and extruding this aluminum alloy S by means of a ram 3 into the other container or the die 2 as illustrated in FIG. 1. Preferably, this process is repeated several times on the material under treatment.

The present inventors have found that when this method is applied for an aluminum alloy, an aluminum alloy material can be vested with strength surpassing the strength obtained by the conventional work hardening and, at the same time, improved markedly in toughness without a decrease in cross-sectional area thereof by a simple process. They have consequently perfected the present invention. They have also found that this process effectively unifies the macro segregation and micro segregation of a cast material and allows omission of the hot and protracted homogenizing heat treatment which is generally practiced. They have further found that the effects mentioned above can be obtained even if the cross-sectional area of the material is decreased in the die 2.

The magnitude of shear deformation exerted on a given aluminum alloy by the method for lateral extrusion of the present invention varies with the angle at which the two containers or one container and one die are joined. Generally, the incremental strain intensity, Δεi, produced per round of extrusion (one passage) by the shear deformation of this nature is given by the following formula (1):

$$\Delta\epsilon i = \frac{2}{\sqrt{3}} \cdot \text{cotan}\,\psi \tag{1}$$

$$ERR = \frac{A_o}{A} = \exp(\Delta\epsilon i) \tag{2}$$

$$EAR = \left(1 - \frac{1}{ERR}\right) \times 100 \tag{3}$$

$$EE = (ERR - 1) \times 100 \tag{4}$$

wherein Δεi stands for the incremental strain intensity, ψ for ½ of the inner angle of union, ERR for the ratio of cross-sectional area of the material before and after the working, Ao for the cross-sectional area before the working, A for the cross-sectional area after the working, EAR for the equivalent percent cross-sectional area reduction before and after the working, and EE for the equivalent strain (synonymous with "equivalent elongation").

To be specific, the strain intensity is 1.15 (equivalent elongation: 220%) when the inner angle of union between two container or between one container and one die is right angle (90°) and the strain intensity is 0.67 (equivalent elongation: 95%) when the inner angle is 120°. By laterally extruding a given aluminum alloy at a right angle without any change in the cross-section, the alloy can be given a magnitude of strain equalling a reduction ratio (percent cross-sectional area reduction) of 69% obtained by rolling.

By repeating the process mentioned above, the strain can be accumulated infinitely in the material without a change in the cross-sectional area thereof. The cumulative strain intensity, εt, imparted to the material by this repetition of the process is given by the following formula (5):

$$\epsilon_t = \Delta\epsilon_i \times N \tag{5}$$

wherein εt stands for the cumulative strain intensity and N for the number of rounds of extrusion.

Theoretically the larger the number of repetitions (N) is, the better will the outcome be. Actually, it is noted that the effect of the repetition is saturated at a certain number of repetitions, depending on the kind of alloy. For the ordinary stretching grade aluminum alloy, four repetitions (cumulative strain intensity: 4.6, equivalent elongation: 10,000% when the inner angle of union is a right angle) can produce an ample effect. Although the strain could be infinitely accumulated by the rolling, the cross-sectional area of the material would be inevitably decreased infinitely at the same time. In this respect, the method of rolling contrasts well with the method of the present invention.

The present inventors have also found that when the conventional material is subjected to strong strain working by the method of lateral extrusion of the present invention, the particle diameter of crystal grains in the material and the solid-solution state of Mg in the crystal grains can be controlled and the serration can be consequently repressed. It has been also found that the material resulting from this strong strain working enjoys high reliability as a material because it shows large extents of elongation and reduction of area, excels in workability, possesses high strength, and manifests large capacities for shock absorption and dynamic fracture toughness.

The serration is thought to be caused by the fixation of dislocation by the ambience of the solute and the relief thereof from the fixation by the exerted stress. For the repression of the serration, the method which decreases the concentration of Mg in the grains or the method which causes grain boundaries destined to function as barriers to be distributed at a high density immediately after the relief of dislocation from the fixation is thought to be effective. The former method is effected by introducing dislocations, inducing accumulation of Mg solute atoms near the cell walls or the subgrain boundaries formed by the polygonization of grains during the course of recovery, and consequently decreasing the apparent Mg concentration in the crystal grains. The latter method is implemented by finely dividing the crystal grains.

The cold or hot working by rolling may be conceived as a means for embodying the former method. This means, however, possibly poses the problem that the increase of the ratio of working entails such drawbacks as lowered ductility, anisotropy, and stress corrosion cracking. The present invention, therefore, contemplates controlling the fine division of crystal grains and the Mg concentration in the crystal grains by the strong working by the process of lateral extrusion to repress the serration and exalt the toughness of the aluminum alloy.

The lateral extrusion according to the present invention is carried out properly, at the lowest possible temperature. However, the resistance of a given alloy to deformation tends to increase and the ability of the alloy to deform tends to decrease in proportion as the temperature lowers. Therefore, the lateral extrusion is usually carried out at a proper temperature which varies from one alloy to another in due respect to the strength of the extruding tool and for the purpose of obtaining a whole extrudate. Generally, it is carried out at a temperature of not more than 300° C., preferably at or below the recrystallization temperature of the alloy, and more preferably at or below the recovery temperature thereof. The recrystallization temperature or the revovery temperature is varied by the degree of the working which is exerted on the material. Where $\psi=45°$ (lateral extrusion at 90°), the typical extruding temperature is in the range of from room temperature to 150° C. for the Al—Mg—Si system A6063 alloy which represents the stretching grade aluminum alloys, in the range of from room temperature to 200° C. for the Al—Mg system A5056 alloy, and from 50° C. to 200° C. for the Al—An—Mg—Cu system A7075 alloy. The extruding temperature is varied by the angle of extrusion. It can be lowered in proportion as the angle is increased. This is because the extruding force (the energy required for shear deformation) decreases and the restraint imposed on the material by the ability thereof to deform relaxes.

When the texture of a laterally extruded material is observed under an optical microscope or a transmission electron microscope, it is found that the crystal grains measuring 200 to 500 microns before working are notably divided by three to four rounds of extrusion into minute grains (including dislocated cell structure, subgrains, and recrystallized texture) measuring about 0.1 micron. When a metallic material is worked, the greater part of the energy of plastic deformation is converted into heat and part thereof is accumulated in the form of point defects, dislocation, stacking fault, or inner stress in the material. The accumulation of these lattice defects forms a cause for hardening (strengthening). The crystal grains, on exposure to strong working, are stretched out and, at the same time, caused to gain in density of dislocation. The stretched crystal grains assume therein a three-dimensional network structure (cell structure) of dislocations as a substructure. The cells undergo gradual size reduction in proportion as the working grows. The cell walls of a high density of dislocations inherently have a thickness and are considered microscopically to have smaller cell structures. In the material treated by the method of the present invention, cell walls having a thickness are not observed. The cell walls, therefore, do not qualify as a characteristic structure obtained by the method of the present invention.

It is generally held that the cell structure is transformed into subgrains by the recovery (initial stage of release of accumulated energy; not accompanied by change in texture) accompanied by rearrangement of defects and this rearrangement of defects is believed to occur when the material is heated to a temperature in the range of ⅓ to ½ of the melting point (absolute temperature). The lateral extrusion is carried out at a still lower temperature. It is inferred that the transition to the subgrains occurred because the markedly strong working productive of an equivalent elongation exceeding 1,000% does not allow an increase in density of dislocations but lowers the transition temperature to subgrains, or the subgrains predominate because the heat of deformation by the strong working elevates the temperature of the material above the apparent temperature. Heretofore, the thermo-mechanical treatment has been known as a means for finely dividing the crystals of aluminum alloy. This method is unfit for the fine division of crystals to diameters of not more than 1 micron to be performed on a commercial scale. A material composed of crystals measuring not more than 1 micron in diameter cannot be produced on a commercial scale unless the method of the present invention which is capable of exerting strong working forcibly at a low temperature is adopted. Moreover, the texture of this material is stable in the range of temperatures applicable to commercial operations because the individual crystals do not possess a high density of dislocations peculiar to a worked texture.

The texture which is composed of fine crystal grains (or subgrains) measuring not more than 1 micron (preferably not more than 0.5 micron) characterizes the aluminum alloy material which is obtained by the method of the present invention. This texture imparts a characteristic feature to the mechanical properties of the material. Generally, the method for strengthening a material is known in numerous forms such as, for example, work strengthening, solid solution strengthening, precipitation strengthening, and dispersion strengthening. Invariably in these methods, such indexes of suppleness of the material as elongation, reduction of area, and Charpy impact value are degraded and, as a natural consequence, the magnitude of fracture toughness is lowered in proportion as the material is strengthened. The fine division of crystals may be cited as a means for strengthening a material without loss of suppleness. The material gains in strength in proportion as the crystals of the material are finely divided. This relation is known as "Hall-Petch law." Since the texture of the material which is obtained by the method of the present invention is composed of very minute crystal grains and has a high density of dislocations as described above, the material has high strength, shows high elongation, reduction of area, and Charpy impact value, and excels in secondary working properties. The method of the present invention, therefore, can provide an aluminum alloy material which exhibits strength and toughness at high well balanced levels.

Further, the method of the present invention is effective in breaking and unifying the segregation of a cast texture and an alloy composition. It, therefore, permits omission of the homogenizing heat treatment which has been heretofore performed on nearly all aluminum alloys and, in this respect, proves highly advantageous in terms of cost.

As described in detail above, the method of the present invention, by finely dividing the crystals of the material without a decrease in the cross-sectional area of the material, can provide an aluminum alloy material which enjoys a generous improvement in mechanical properties and, at the same time, excels not only in strength but also in suppleness of the materia, toughness, and secondary working properties. The aluminum alloy material which is obtained by the present invention excels in strength, toughness, and workability and incurs substantially no decline of strength in the region of high strain rate. Moreover, since the method of the present invention, unlike the conventional method of thermo-mechanical treatment, obviates the necessity for exacting control and numerous complicated steps, it allows the aluminum alloy material possessing such outstanding mechanical properties as mentioned above to be produced at a low cost. In accordance with the method of the present invention, the aluminum alloy material is enabled to be further strengthened by additionally performing cold working on the material subsequently to the lateral extrusion. The method of the present invention, therefore, contributes to enabling all the structural members to reduce weight and gain in strength.

The method of extrusion according to the present invention can be applied for all the aluminum alloys, particularly advantageously for the alloys of the kind intended for heat treatment. The A6063 alloy and A5056 alloy specified in JIS (Japanese Industrial Standard) and shown in Table 1 below are typical examples of such aluminum alloys. Further, the method of the present invention can be applied not only for such aluminum alloys as are produced by the homogenizing heat treatment, the hot extrusion and other intermediate working operations, and other methods performed at room temperature or in a heated area but also for the aluminum alloys resulting from casting.

TABLE 1

| Symbol of | JIS alloy composition (wt %) | | | | | | | | |
|---|---|---|---|---|---|---|---|---|---|
| alloy A | Si | Fe | Cu | Mn | Mg | Cr | Zn | Ti | Al |
| 6063 | 0.20 \| 0.60 | 0.35 or less | 0.10 or less | 0.10 or less | 0.45 \| 0.90 | 0.10 or less | 0.10 or less | 0.10 or less | balance |
| 5056 | 0.30 or less | 0.40 or less | 0.10 or less | 0.05 \| 0.20 | 4.5 \| 5.6 | 0.05 \| 0.20 | 0.10 or less | — | balance |

EXAMPLE 1

A billet, 155 mm in diameter, of an A6063 alloy having a composition falling in the range shown in Table 1 was hot extruded into a round bar, 25 mm in diameter. The round bar consequently obtained was heat-treated at 580° C. for four hours and then quenched in water to obtain a sample. Meanwhile, a round bar similarly obtained by the hot extrusion was subjected in its unmodified form to an artificial aging (T5) treatment at 190° C. for three hours to obtain a comparative sample. The sample was inserted into one of two containers (both measuring 25 mm in inner diameter) joined at a right angle ($\psi$=45°) and laterally extruded four times at 100° C. to afford a treated material, 25 mm in diameter. As a result, an aluminum alloy material which had been worked with a cumulative strain intensity ($\epsilon t$) of 4.6 (equivalent elongation 10,000%) according to the aforementioned formula was obtained.

Figure 2:
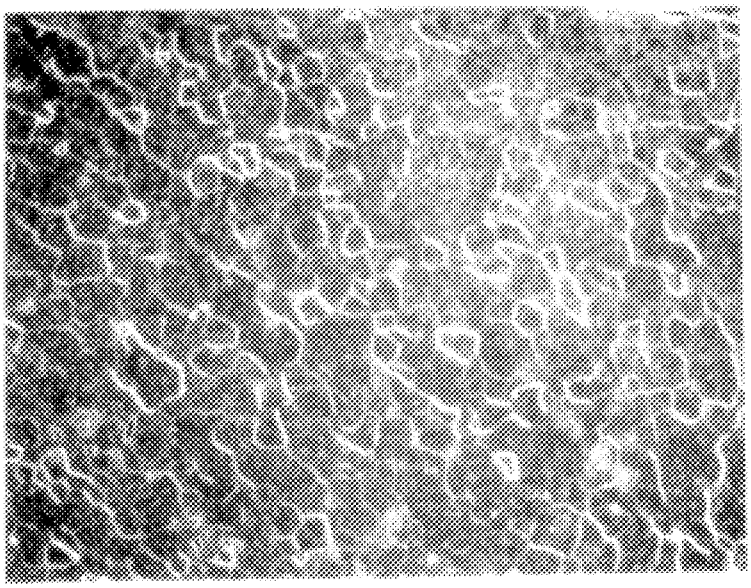
FIG. 2 is a micrograph (50 magnifications) taken through an optical microscope of the texture of an aluminum alloy A6063 prior to the lateral extrusion of the alloy in Example 1.
Figure 3:
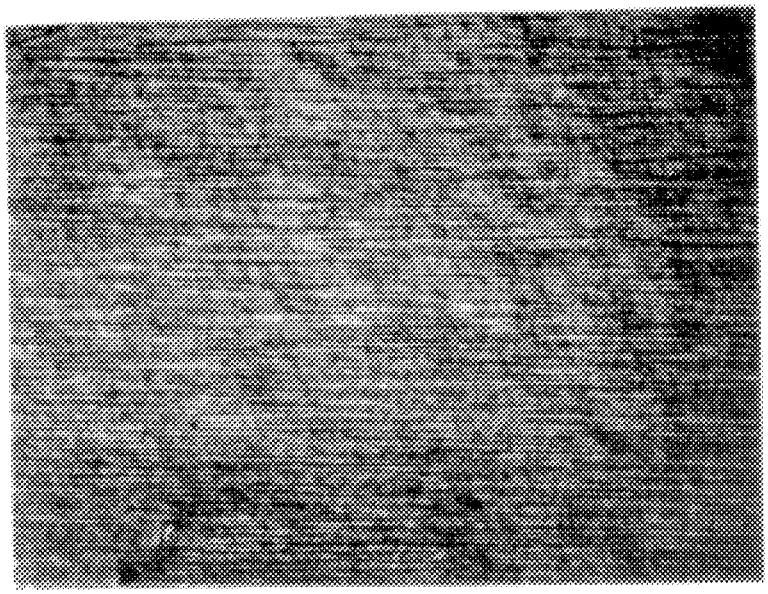
FIG. 3 is a micrograph (50 magnifications) taken through an optical microscope of the texture of the aluminum alloy A6063 subsequently to the lateral extrusion of the alloy according to the present invention.

The micrographs (50 magnifications) taken through an optical microscope of the texture of a material before and after the lateral extrusion at 100° C. are shown respectively in FIG. 2 and FIG. 3. As shown in FIG. 2 and FIG. 3, the crystal grains having a particle diameter in the approximate range of 100 to 200 microns before the lateral extrusion were converted by the lateral extrusion into a fibrous texture which did not allow easy measurement of particle diameter.

Figure 4:
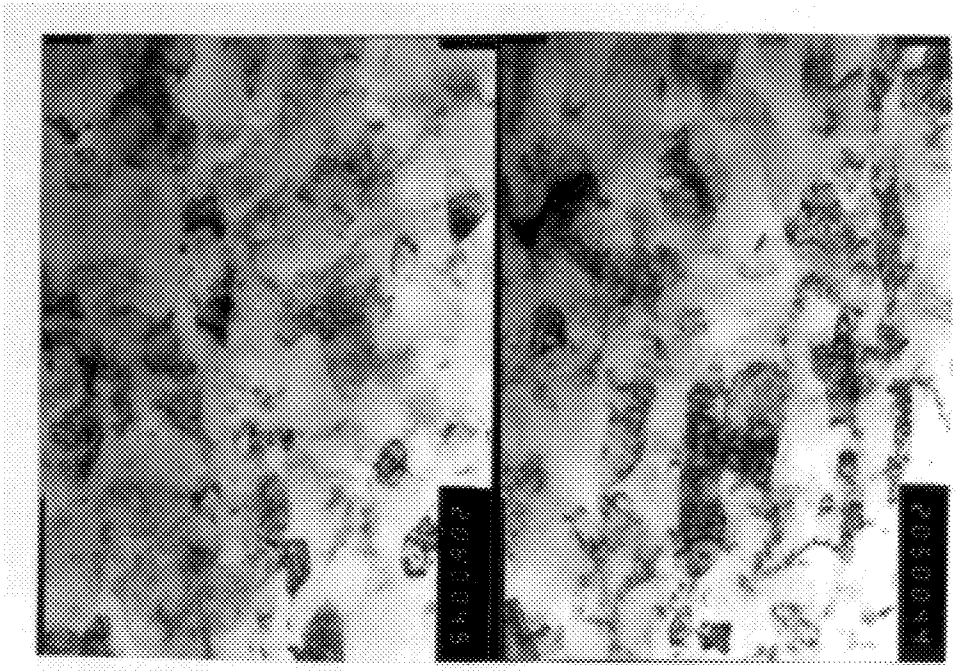
FIG. 4 is a transmission electron micrograph (20,000 magnifications) of the texture of the aluminum alloy A6063 subsequently to the lateral extrusion of the alloy according to the present invention.
Figure 5:
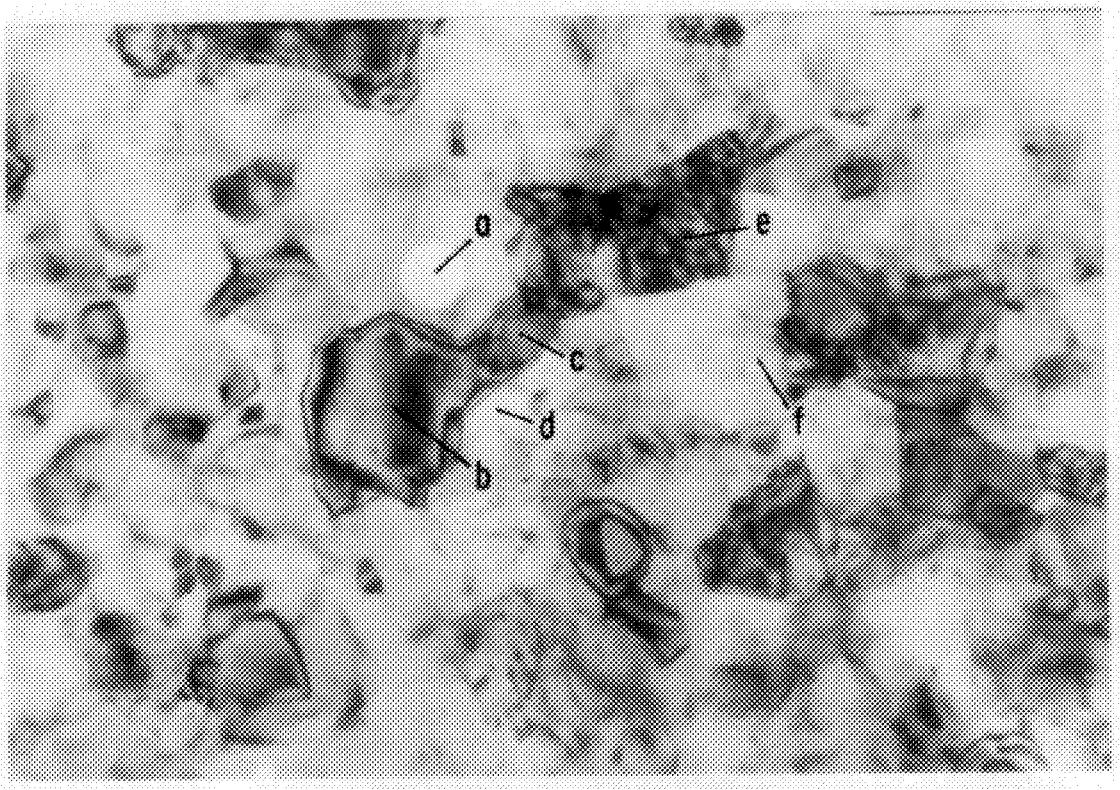
FIG. 5 is a transmission electron micrograph (40,000 magnifications) of the texture of the aluminum alloy A6063 exposed to an electron beam subsequently to the lateral extrusion of the alloy according to the present invention.
Figure 6A:
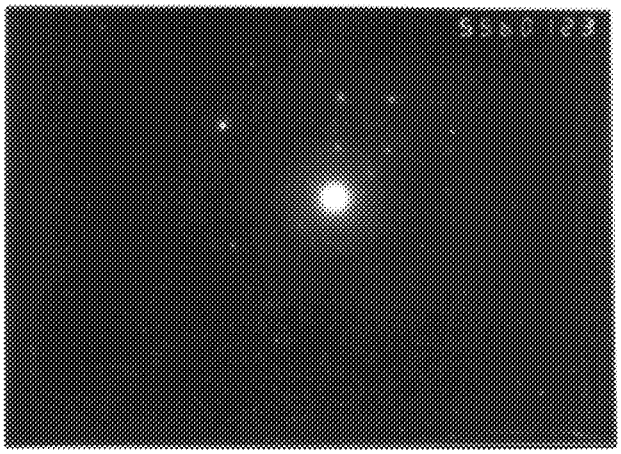
FIGS. 6A through 6F are transmission electron micrographs illustrating electron diffraction images produced by the impingement of an electron beam respectively at the positions a, b, c, d, e, and f of the texture of aluminum alloy shown in FIG. 5.
Figure 6B:
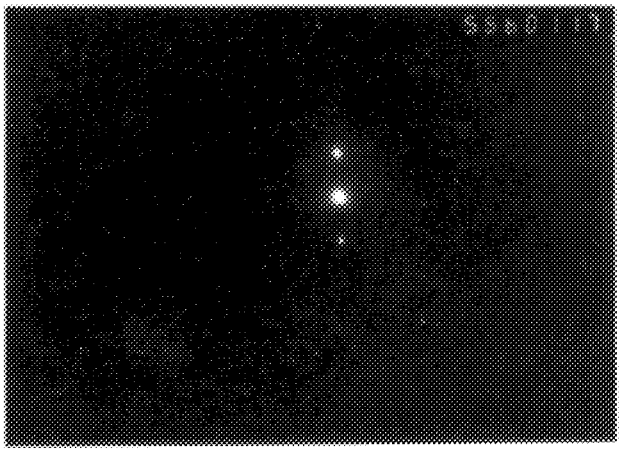
Figure 6C:
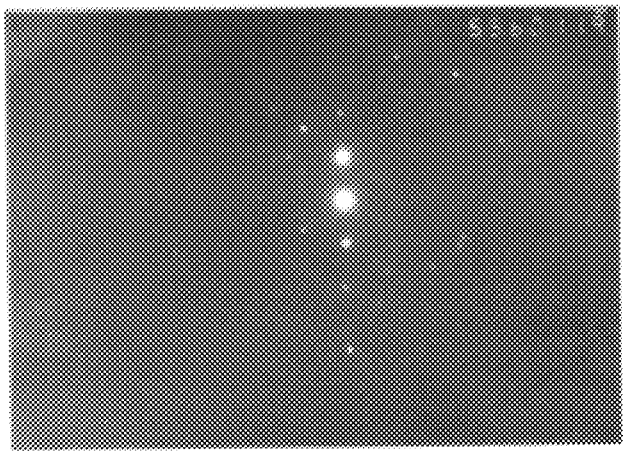
Figure 6D:
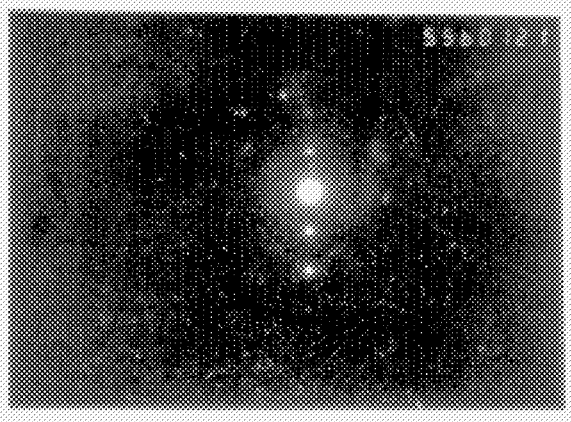
Figure 6E:
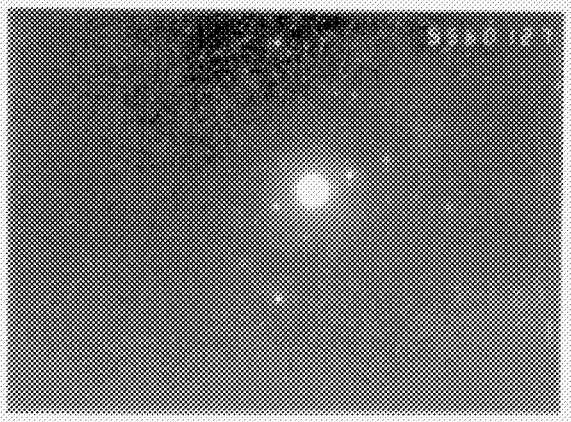
Figure 6F:
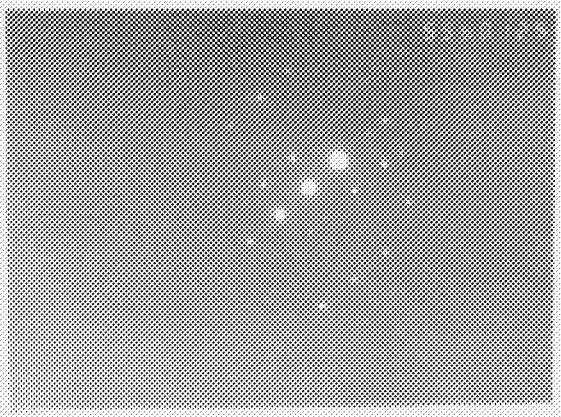

The micrographs (20,000 magnifications) taken through a transmission electron microscope (TEM) of the material subsequently to the lateral extrusion are shown in FIG. 4. FIG. 4 shows images photographed at two portions. It is clearly noted from FIG. 4 that the crystal grains have been reduced to minute grains of diameters in the approximate range of 0.1 to 0.5 micron, in consequence of the lateral extrusion.

When the minute crystal grains are examined by the electron diffraction to determine the orientation, it is found that most of them are arranged within an angle of several degrees (°) as shown in FIGS. 6A through 6F. This fact indicates that they are subgrains or a recrystallized texture having a strong orientation. FIG. 5 and FIGS. 6A through 6F respectively represent a TEM image (40,000 magnifications) and electron diffraction patterns of textures exposed to an electron beam. FIGS. 6A through 6F represent electron diffraction images produced by the impingement of an electron beam respectively at the positions a to f shown in FIG. 5.

The results of the test of the aluminum alloy material for mechanical properties before and after the lateral extrusion are shown in Table 2.

TABLE 2

| Mechanical properties | | Before working | Lateral extrudate | T5 material |
|---|---|---|---|---|
| Strain rate ($s^{-1}$) $1.7 \times 10^{-3}$ | Tensile strength (MPa) | 160 | 310 | 250 |
| | Elongation (%) | 30 | 25 | 22 |
| Strain rate ($s^{-1}$) $1 \times 10^{3}$ | Tensile strength (MPa) | — | 350 | 275 |
| | Elongation (%) | — | 28 | 26 |

As shown in Table 2, when the test strain rate is fixed at $1.7\times10^{-3}$/s, the tensile strength is 250 MPa for the material of T5 treatment and not less than 310 MPa for the lateral extrudate and, when the test strain rate is fixed at $10^3$/s, the tensile strength is 275 MPa for the material of T5 treatment and 350 MPa for the lateral extrudate, indicating that the lateral extrudates invariably show an improvement of not less than 20% over the materials of T5 treatment cited for comparison. In spite of the strengthening, the lateral extrudates show a greater elongation than the materials of T5 treatment at either of the test strain rates.

Figure 7:
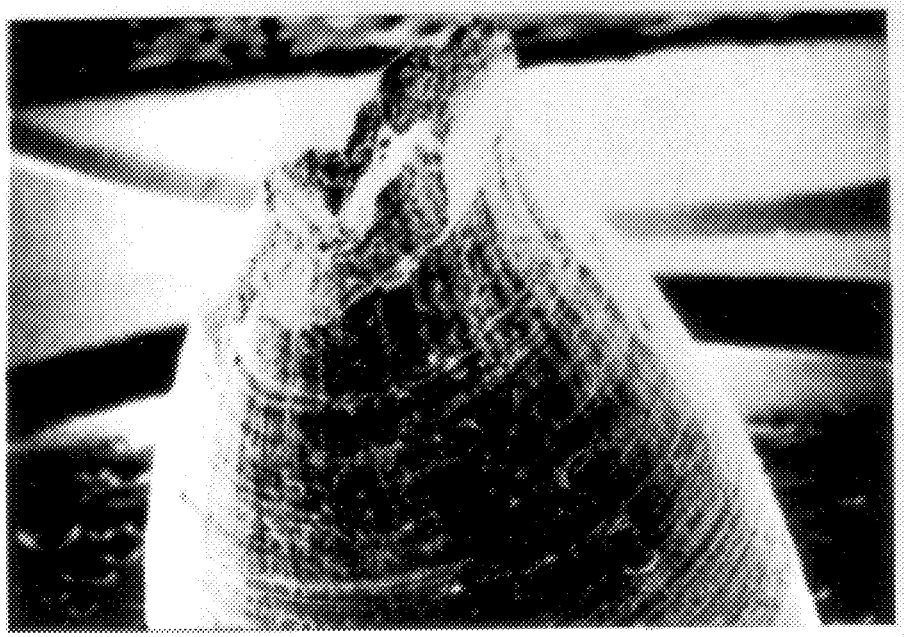
FIG. 7 is a micrograph (35 magnifications) taken through a scanning electron microscope of a test piece of the laterally extruded material of aluminum alloy A6063 obtained in Example 1 subsequently to a tensile test (room temperature and strain rate $1.7\times10^{-3}$/s)
Figure 8:
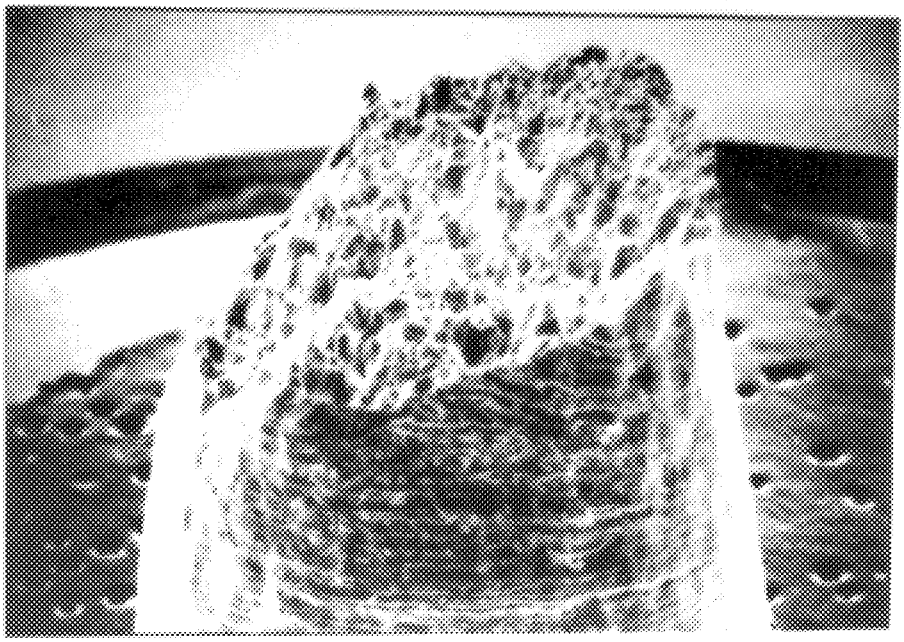
FIG. 8 is a micrograph (35 magnifications) taken through a scanning electron microscope of a test piece of the material of T5 treatment of aluminum alloy A6063 subsequently to a tensile test (room temperature and strain rate $1.7\times10^{-3}$/s)

The micrographs (35 magnifications) taken through a scanning electron microscope (SEM) of the test pieces respectively of the lateral extrudate and the material of T5 treatment after the tensile test (room temperature and strain rate $1.7\times10^{-3}$/s) are shown in FIG. 7 and FIG. 8. It is clearly noted from FIG. 7 and FIG. 8 that the lateral extrudate exhibits a larger reduction of area (percent area reduction of about 70%) than the material of T5 treatment (about 40%), indicating that the lateral extrudate abound in workability.

Figure 9:
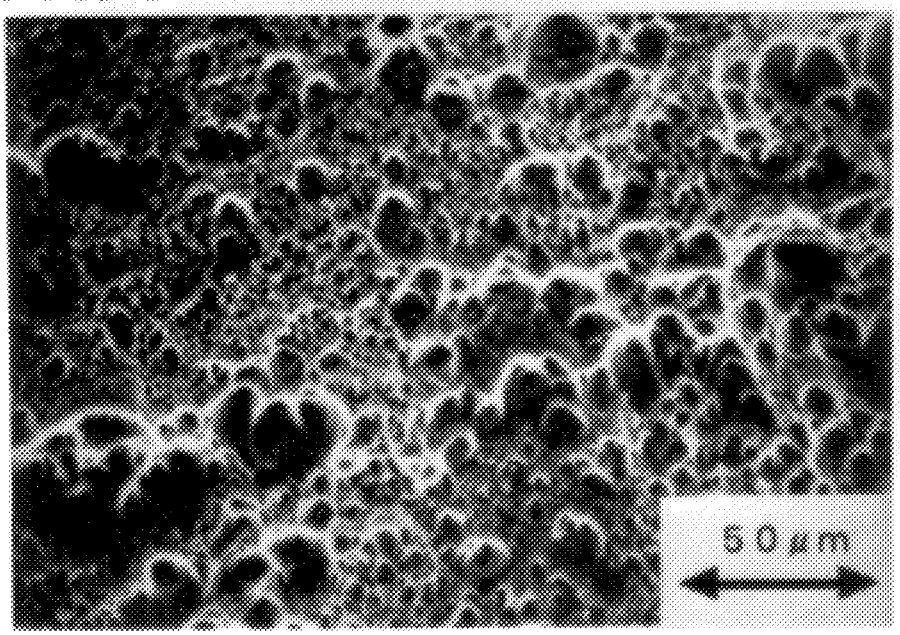
FIG. 9 is a micrograph (500 magnifications) taken through a scanning electron microscope of the rupture cross-section of the laterally extruded material of aluminum alloy A6063 obtained in Example 1.
Figure 10:
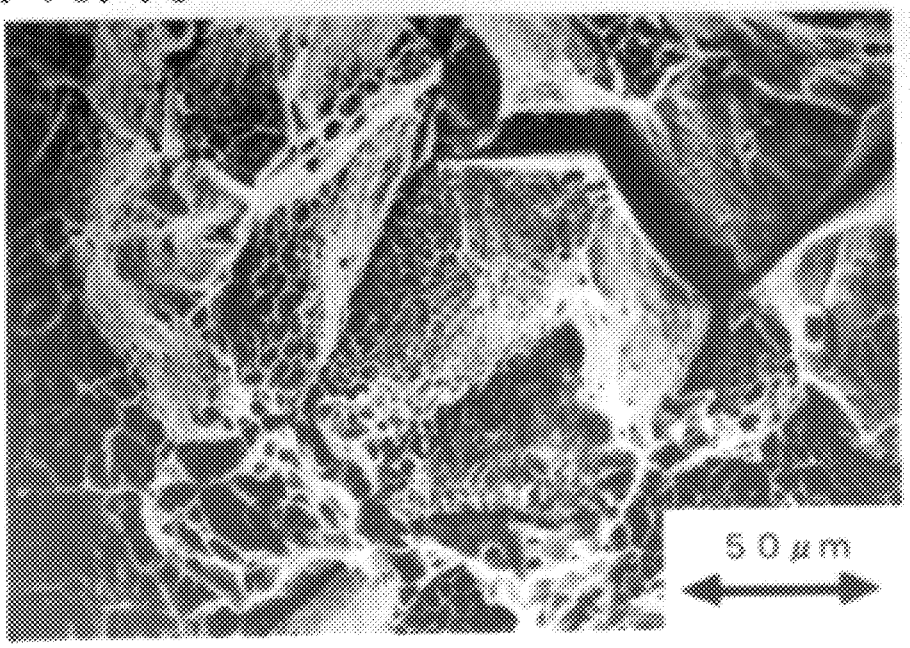
FIG. 10 is a micrograph (500 magnifications) taken through a scanning electron microscope of the rupture cross-section of the material of T5 treatment of aluminum alloy A6063.

The SEM micrographs (500 magnifications) of the fractured surfaces of the test pieces mentioned above are shown in FIG. 9 and FIG. 10. It is clearly noted from FIG. 9 and FIG. 10 that, while the material of T5 treatment shows a fracture of grain boundaries of about 100 microns, the lateral extrudate shows a dimple pattern conforming to the shape of grains of the order of submicrons, indicating that the lateral extrudate abounds in ductility.

The results of the test for Charpy impact performed on the lateral extrudate and the material of T5 treatment are shown in Table 3. For this test, test pieces with a U notch of JIS No. 3 were used.

TABLE 3

| Mechanical properties | Lateral extrudate | T5 material |
|---|---|---|
| JIS energy (kgf · m) | 5.1 | 2.15 |
| Impact value (kgf · m/cm$^2$) | 6.4 | 2.8 |
| Maximum stress (kgf/mm$^2$) | 71 | 61 |

As shown in Table 3, the fracture energy (JIS energy) which is one of the indexes of toughness was 2.15 kgf·m (maximum stress 61 kgf/mm$^2$) for the material of T5 treatment and not less than 5.1 kgf·m (maximum stress 71 kgf/mm$^2$) for the lateral extrudate. The expression "not less than 5.1 kgf·m" is used here because the lateral extrudate was not completely fractured but was barely bent with a partial crack. The JIS energy at which a given test piece is not broken in the test for Charpy impact is invariably expressed as 5.1 kgf·m.

The Charpy impact value was 2.8 kgf·m/cm$^2$ (maximum stress 61 kgf/mm$^2$) for the material of T5 treatment and 6.4 kgf·m/cm$^2$ (maximum stress 71 kgf/mm$^2$) for the lateral extrudate.

The round bar obtained by the lateral extrusion at 90° could be easily rolled to a ratio of 80% of reduction in cross-sectional area. The fact that the material strengthened to this extent could be formed by further strong working is ascribed largely to the texture fine and deficient in dislocations. The rolled material exhibited a tensile strength of 410 MPa. This fact indicates that the rolling further strengthened the material.

As described above, the material of A6063 alloy produced by the lateral extrusion in accordance with the present invention mainly comprised crystal grains (containing dislocated cell structure and subgrains), 0.2 to 0.3 micron in diameter, and exhibited a tensile strength of not less than 300 MPa, an elongation of not less than 25%, a reduction of area of not less than 70%, and a Charpy impact value more than three times that of the material of T5 treatment. Thus, this material possessed strength and toughness at such highly balanced levels as are never attained by the conventional thermo-mechanical treatment and, moreover, excelled in secondary workability.

EXAMPLE 2

A sample was prepared by following the procedure of Example 1 while using an A5056 alloy having a composition falling in the range shown in Table 1 instead. As materials for comparison, the O material which was a completely annealed material of the alloy mentioned above and the H38 material which was obtained by tempering (stabilizing) a wholly hardened (H8) material for the sake of impartation of ductility thereto were used.

Figure 11:
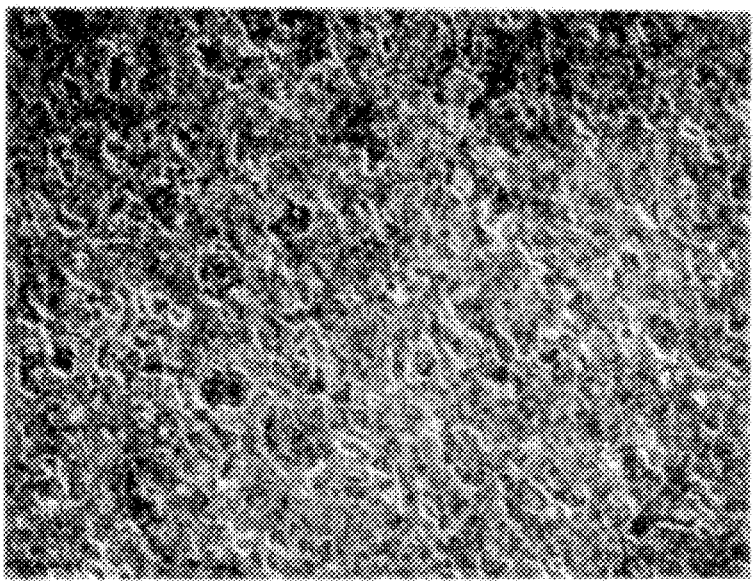
FIG. 11 is a micrograph (100 magnifications) taken through an optical microscope of the texture of an aluminum alloy A5056 prior to the lateral extrusion of the alloy in Example 2.
Figure 12:
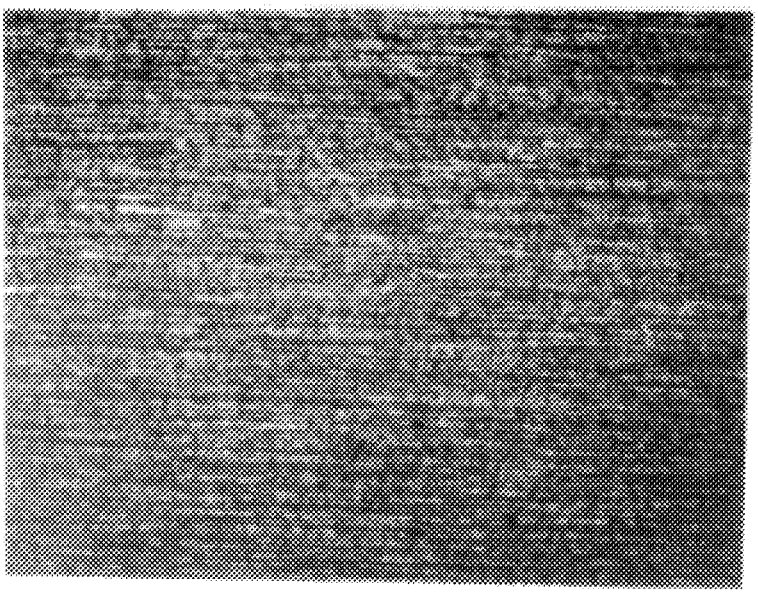
FIG. 12 is a micrograph (100 magnifications) taken through an optical microscope of the texture of the aluminum alloy A5056 subsequently to the lateral extrusion of the alloy according to the present invention.

The micrographs (100 magnifications) taken through an optical microscope of the texture of the material before and after the lateral extrusion at 100° C. are shown respectively in FIG. 11 and FIG. 12.

Figure 13:
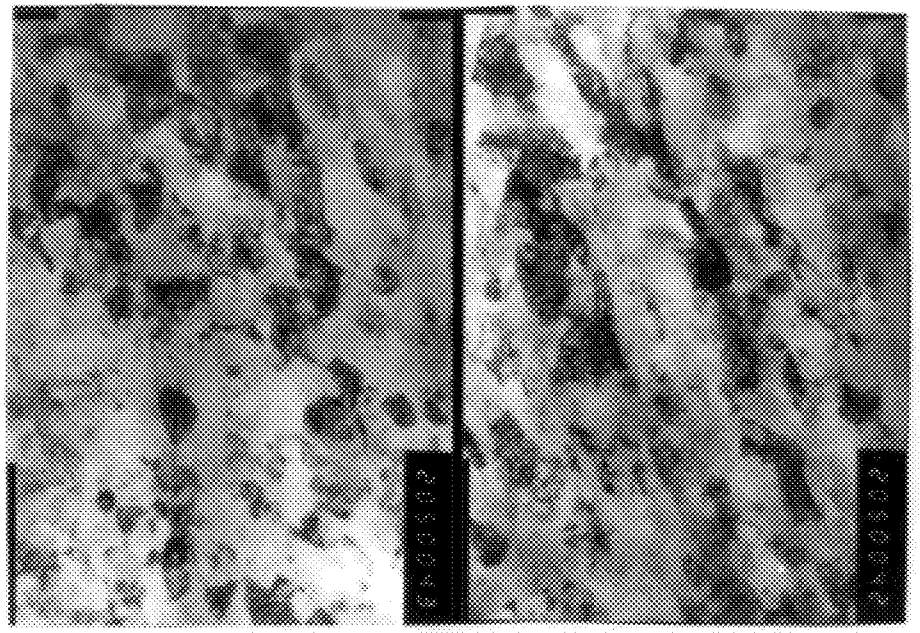
FIG. 13 is a transmission electron micrograph (20,000 magnifications) of the texture of the aluminum alloy A5056 subsequently to the lateral extrusion of the alloy according to the present invention.

The TEM images (20,000 magnifications) of the material after the lateral extrusion are shown in FIG. 13. FIG. 13 shows images photographed at two portions.

It is clearly noted from FIG. 11 and FIG. 13 that the crystal grains before the lateral extrusion had diameters of about 50 microns and those after the lateral extrusion had reduced diameters in the approximate range of 0.05 to 0.6 micron.

The results of the test for mechanical properties performed on the aluminum alloy material before and after the lateral extrusion are shown in Table 4.

TABLE 4

| Mechanical properties | | Lateral extrudate | O material | H38 material |
|---|---|---|---|---|
| Strain rate ($s^{-1}$) $1.7 \times 10^{-3}$ | Tensile strength (MPa) | 390 | 270 | 350 |
| | Elongation (%) | 25 | 40 | 19 |
| Strain rate ($s^{-1}$) $1 \times 10^{3}$ | Tensile strength (MPa) | 430 | 250 | — |
| | Elongation (%) | 30 | 54 | — |

As shown in Table 4, the tensile strength was 390 MPa when the test strain rate was $1.7\times10^{-3}$/s and 430 MPa when the test strain rate was $10^3$/s. In either case, the tensile strength of the lateral extrudate markedly surpassed that of the O material and showed an improvement of not less than 10% over that of the H38 material. The elongation of the lateral extrudate, though lower than that of the O material, surpassed that of the H38 material in spite of the increase of strength.

Figure 14:
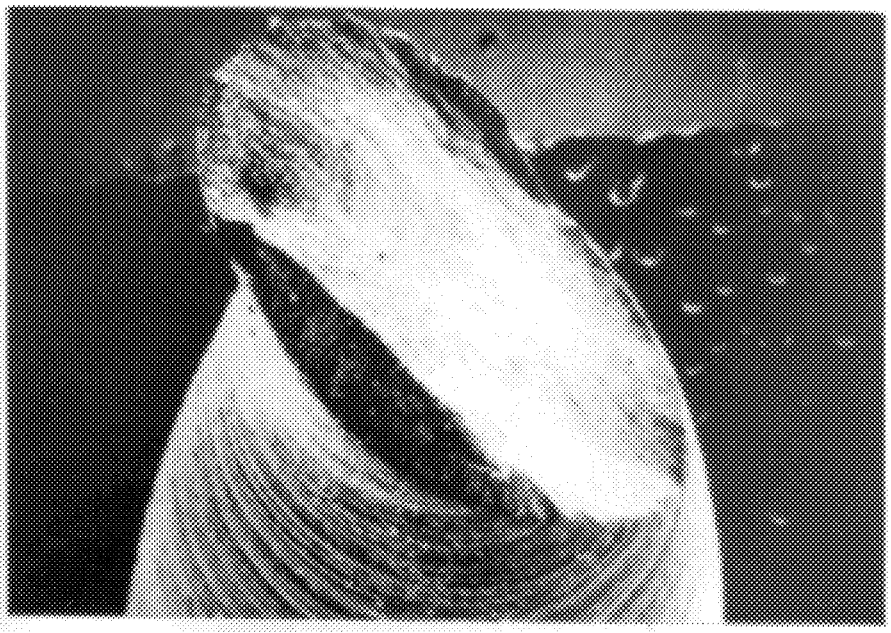
FIG. 14 is a micrograph (35 magnifications) taken through a scanning electron microscope of a test piece of the laterally extruded material of aluminum alloy A5056 obtained in Example 2 subsequently to a tensile test (room temperature and strain rate $1.7\times10^{-3}$/s)
Figure 15:
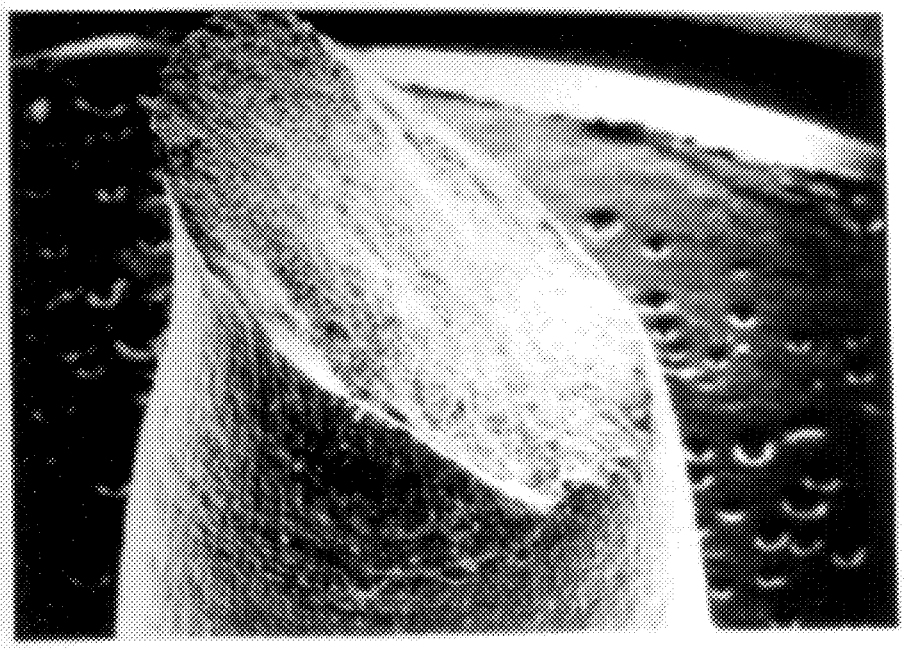
FIG. 15 is a micrograph (35 magnifications) taken through a scanning electron microscope of a test piece of the O material (annealed material) of aluminum alloy A5056 subsequently to a tensile test (room temperature and strain rate $1.7\times10^{-3}$/s)

The SEM micrographs (35 magnifications) of the test pieces respectively of the lateral extrudate and the O material after the tensile test (room temperature and strain rate $1.7\times10^{-3}$/s) are shown in FIG. 14 and FIG. 15. It is clearly noted from FIG. 14 and FIG. 15 that the lateral extrudate exhibited a reduction of area (percent area reduction) of about 50%. This fact indicates that this lateral extrudate possessed the same degree of workability as the O material.

Figure 16:
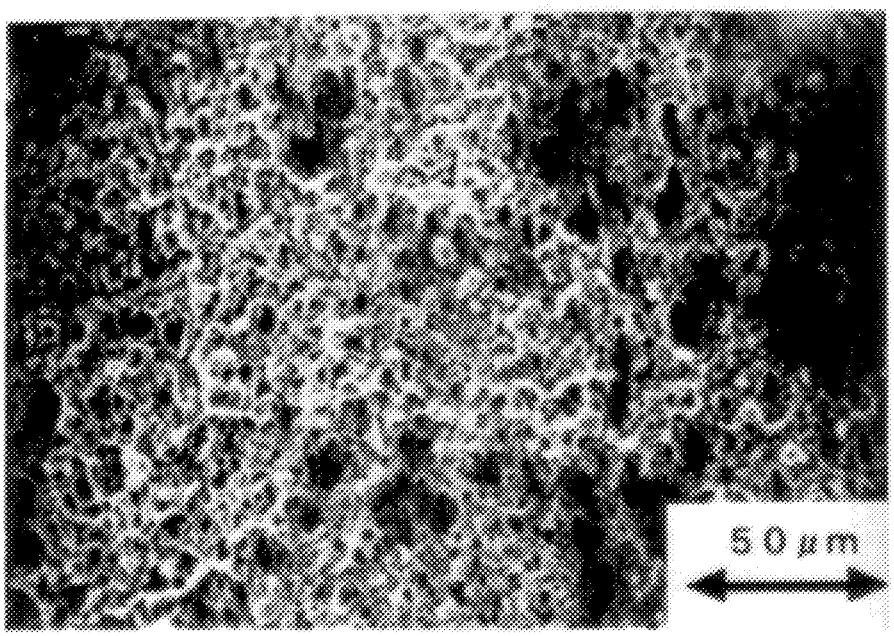
FIG. 16 is a micrograph (500 magnifications) taken through a scanning electron microscope of the fractured surface of the laterally extruded material of aluminum alloy A5056 obtained in Example 2.
Figure 17:
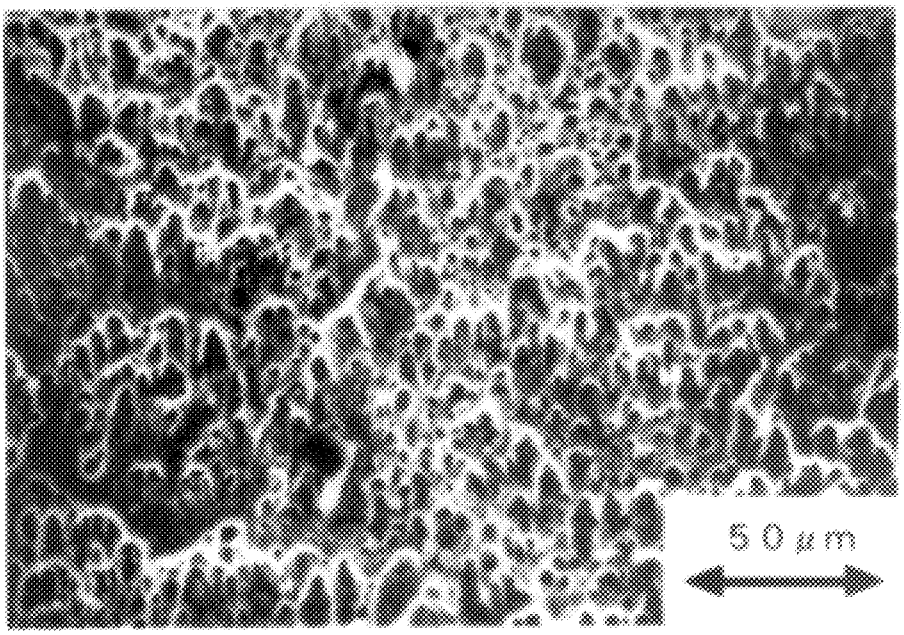
FIG. 17 is a micrograph (500 magnifications) taken through a scanning electron microscope of the fractured surface of the O material (annealed material) of aluminum alloy A5056.

The SEM micrographs (500 magnifications) of the fractured surfaces of the test pieces mentioned above are shown respectively in FIG. 16 and FIG. 17. It is noted from these micrographs that the lateral extrudate assumed a dimple pattern conforming to the shape of minute grains and abounded in ductility.

The results of the test for Charpy impact performed on the lateral extrudate and the O material mentioned above are shown in Table 5. The test pieces with a U notch of JIS No. 3 were used for the test.

TABLE 5

| Mechanical properties | Lateral extrudate | O material |
|---|---|---|
| JIS energy (kgf · m) | 5.1 | 5.1 |
| Impact value (kgf · m/cm$^2$) | 6.4 | 6.4 |
| Maximum stress (kgf/mm$^2$) | 90 | 60 |

As shown in Table 5, the fracture energy (JIS energy), one of the indexes of toughness, was not less than 5.1 kgf·m (maximum stress 90 kgf/mm$^2$) for the lateral extrudate. The Charpy impact value was 6.4 kgf·m/cm$^2$ (maximum stress 90 kgf/mm$^2$).

By the method for lateral extrusion according to the present invention, a material of an A5056 alloy comprising crystal grains measuring less than 1 micron in diameter and exhibiting a tensile strength of 390 MPa (test strain rate $1.7\times10^{-3}$/s) or 430 MPa ($10^3$/s), an elongation of 25% or 30%, a Charpy impact value of not less than 6.4 kgf·m/cm$^2$ (invariably with no perfect fracture), and a reduction of area of 50% was obtained. The tensile strength was about 1.1 times that of the H38 material, which had a very low elongation in the neighborhood of 19%. Thus, it is safe to conclude that the aluminum alloy material obtained by the present invention possessed strength and toughness at high balanced levels.

EXAMPLE 3

An A5056 (Mg: 4.8 wt %) alloy was cast to produce a round bar, 25 mm in diameter. The round bar was heat-treated at 425° C. for four hours and then quenched in water to obtain a sample. Meanwhile, a comparative sample was obtained by hot rolling a round bar obtained in the same manner as above until the diameter decreased to 8 mm and then allowing the elongated round bar to be annealed by cooling in the furnace at 345° C. The sample was inserted into one of two containers (both 25 mm in inner diameter) connected at a right angle ($\psi$=45°) and laterally extruded four times at 100° C. to obtain a treated material, 25 mm in diameter. Consequently, an aluminum alloy material worked with a cumulative strain intensity of 4.6 (equivalent elongation 10,000%) was obtained.

The micrographs taken through an optical microscope of the texture of the material before and after the lateral extrusion at 100° C. were similar to those shown in FIG. 11 and FIG. 12. While the crystal grains before the lateral extrusion had diameters in the neighborhood of 50 microns, those after the lateral extrusion assumed a fibrous texture which defied measurement of particle diameter.

The TEM image of the material after the lateral extrusion was similar to that shown in FIG. 13. The crystal grains after the lateral extrusion had reduced particle diameters in the range of 0.05 to 0.6 micron. Since residual dislocations were observed in the crystal grains and the grain boundaries had no such large thickness as the cell walls, this material may well be concluded as possessing a slightly recovered texture.

Figure 18:
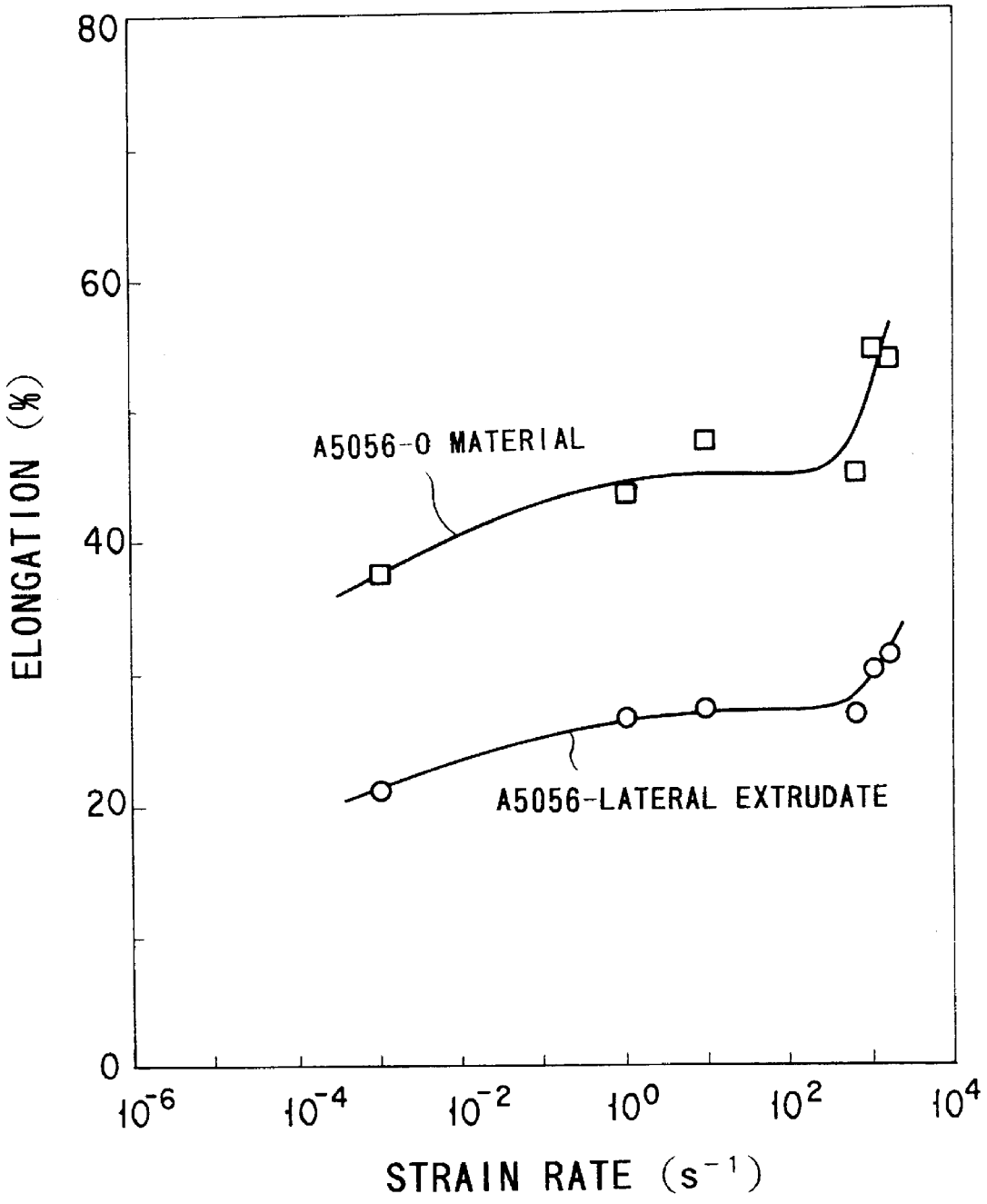
FIG. 18 is a graph showing the relation between the elongation and the strain rate obtained severally of a laterally extruded material and the annealed material of aluminum alloy A5056 in Example 3.

These materials were tested for susceptibility of mechanical properties to the strain rate by the use of three testing devices different in type. An Instron type tester was adopted for a low range of strain rate, $1\times10^{-3}$ to $1\times10^{-1}$ s$^{-1}$, a hydraulic high-speed tester for a medium range of strain rate, $1\times10^{0}$ to $1\times10^{1}$ s$^{-1}$, and a tester adopting the principle of the split Hopkinson bar method for a high range of strain rate, $1\times10^{2}$ to $2\times10^{3}$ s$^{-1}$. The relation between the elongation and the strain rate is shown in FIG. 18. FIG. 18 additionally shows for comparison the data of an annealed material (A5056-O material) of a practical Al aluminum having a Mg content of about 5 wt %. The elongation of the material after the lateral extrusion (lateral extrudate of A5056), similarly to the annealed material, increased in proportion as the strain rate increased. Though the elongation of the material after the lateral extrusion was smaller numerically than that of the annealed material (40 to 50%), it was 20 to 30%, a magnitude equivalent to that of other annealed materials (such as, for example, O material of A5083).

Figure 19:
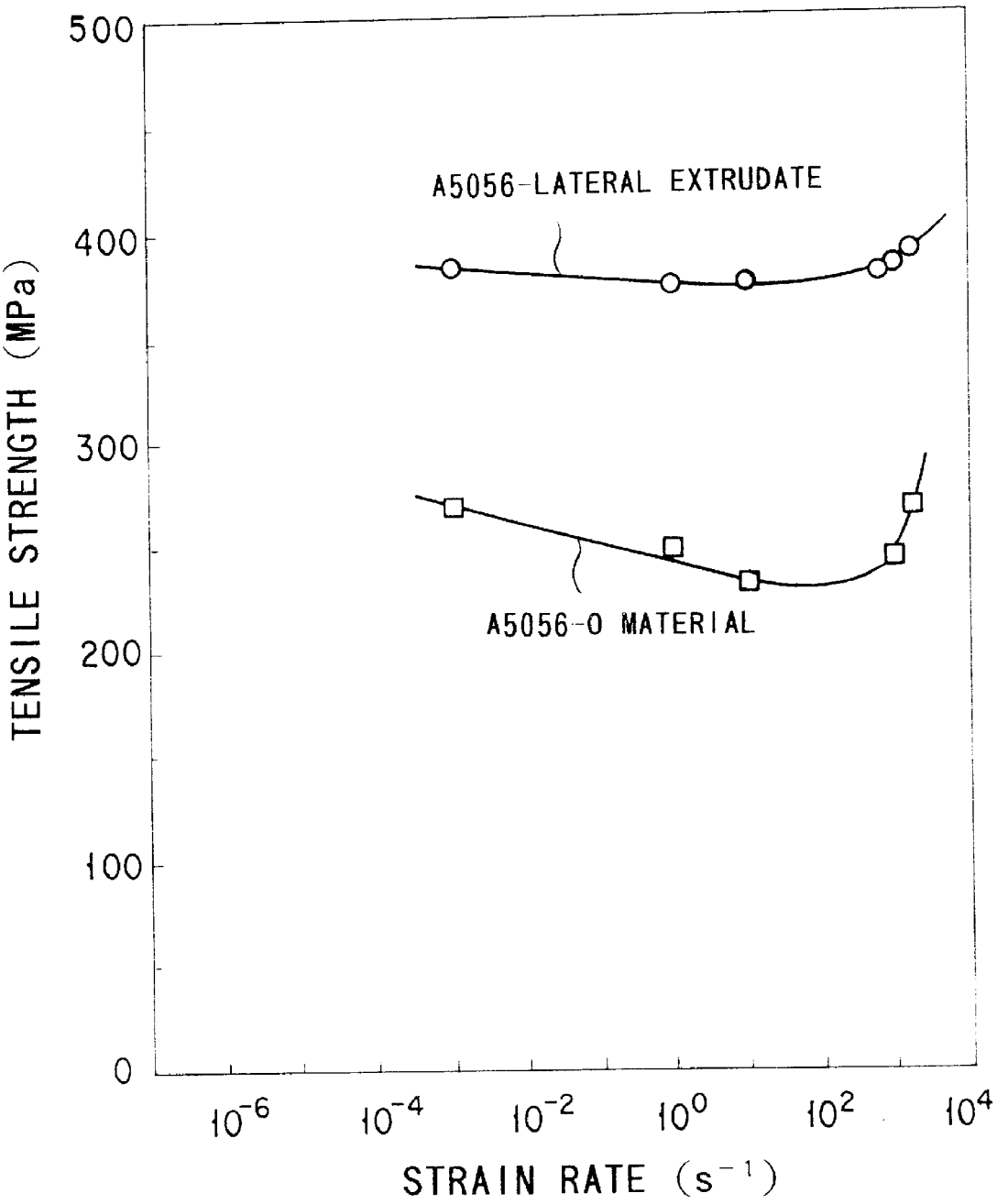
FIG. 19 is a graph showing the relation between the tensile strength and the strain rate obtained severally of the laterally extruded material and the annealed material of aluminum alloy A5056 in Example 3.

The relation between the tensile strength and the strain rate obtained of the material mentioned above is shown in FIG. 19. FIG. 19 likewise shows additionally for comparison the data of the annealed material (A5056-O material) of a practical Al alloy having a Mg content of about 5 wt %. The strength of the material after the lateral extrusion (lateral extrudate of A5056) was not less than 350 MPa, a magnitude larger than the annealed material (A5056-O material). The strength of the annealed material (A5056-O material) decreased in proportion as the strain rate increased at strain rates not exceeding $6.5\times10^{2}$ s$^{-1}$. This negative dependency on strain rate was also observed in other annealed materials. The strength of the material after the lateral extrusion (lateral extrudate of A5056) showed virtually no decline at strain rates not exceeding $6.5\times10^{2}$ s$^{-1}$. The material of A5056 produced by the lateral extrusion turned out to be a tough material comprising crystal grains (containing dislocated cell structure and subgrains), 0.1 to 0.5 micron in diameter, exhibiting a strength of 350 MPa and an elongation of not less than 15%, and suffering no decline of strength and elongation in the range of strain rate of $1\times10^{-3}$ to $2\times10^{3}$ s$^{-1}$ as described above.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A method for the extrusion of an aluminum alloy, which comprises imparting to said aluminum alloy in the process of extrusion shear deformation productive of such strain intensity as equals an equivalent elongation of not less than 10,000%, thereby dividing the microstructure of the aluminum alloy into crystal grains of an average grain or subgrain diameter of not more than 1 μm and producing a material which possesses a fibrous texture having elongated crystal grains and which exhibits a tensile strength of not less than 250 MPa and an elongation of not less than 15%, said step of extrusion being carried out at a temperature not more than 300° C. and wherein said step of extrusion is followed by an additional step of cold working to impart enhanced strength to said material.

2. The method according to claim 1, wherein said step of extrusion is carried out at a temperature not exceeding the recrystallization temperature of said alloy.

3. The method according to claim 1, wherein said step of extrusion is carried out at a temperature not exceeding the recovery temperature of said alloy.

4. A method for the extrusion of an aluminum alloy, which comprises changing the direction of extrusion of a material of said aluminum alloy laterally at an inner angle of less than 180° to impart shear deformation to said material without changing the cross-sectional area of said material and exert thereon strain equaling an equivalent elongation of not less than 220%, thereby dividing the microstructure of the aluminum alloy into crystal grains of an average grain or subgrain diameter of not more than 1 μm and producing a material which possesses a fibrous texture having elongated crystal grains and which exhibits high strength and high toughness, said step of extrusion being carried out at a temperature not more than 300° C, and wherein said step of extrusion is followed by an additional step of cold working to impart enhanced strength to said material.

5. The method according to claim 4, wherein a strain equalling an equivalent elongation of not less than 10,000% is exerted on said aluminum alloy.

6. The method according to claim 4, wherein said step of extrusion is carried out at a temperature not exceeding the recrystallization temperature of said alloy.

7. The method according to claim 4, wherein said step of extrusion is carried out at a temperature not exceeding the recovery temperature of said alloy.

8. The method according to claim 4, wherein said step of extrusion is followed by an additional step of cold working to impart exalted strength to said material.

9. The method according to claim 4, wherein said aluminum alloy is an Al—Mg—Si alloy and said step of extrusion is carried out at a temperature in the range of from room temperature to 150° C.

10. The method according to claim 4, wherein said aluminum alloy is an Al—Mg alloy and said step of extrusion is carried out at a temperature in the range of from room temperature to 200° C.

11. A method for the extrusion of an Al—Mg—Si alloy, which comprises imparting to said alloy in the process of extrusion shear deformation productive of such strain intensity as equals an equivalent elongation of not less than 10,000%, thereby dividing the microstructure of the Al—Mg—Si alloy into crystal grains of an average grain or subgrain diameter of not more than 1 μm and producing a material which possesses a fibrous texture having elongated crystal grains and which exhibits a tensile strength of not less than 250 MPa and an elongation of not less than 15%, said step of extrusion being carried out at a temperature in the range of from room temperature to 150° C. and wherein said step of extrusion is followed by an additional step of cold working to impart enhanced strength to said material.

12. A method for the extrusion of an Al—Mg alloy, which comprises imparting to said alloy in the process of extrusion shear deformation productive of such strain intensity as equals an equivalent elongation of not less than 10,000%, thereby dividing the microstructure of the Al—Mg alloy into crystal grains of an average grain or subgrain diameter of not more than 1 μm and producing a material which possesses a fibrous texture having elongated crystal grains and which exhibits a tensile strength of not less than 350 MPa and an elongation of not less than 15%, said step of extrusion being carried out at a temperature in the range of from room temperature to 200° C. and wherein said step of extrusion is followed by an additional step of cold working to impart enhanced strength to said material.

* * * * *